United States Patent [19]

Elias et al.

[11] 4,043,423

[45] Aug. 23, 1977

[54] DEVICE FOR CONVERTING AN EXTENSION LADDER INTO A STEPLADDER

[76] Inventors: Norman Elias, 265-06, 80th Ave., Floral Park, N.Y. 11004; Joseph Quinn, 326 Highland Ave., Kearny, N.J. 07032

[21] Appl. No.: 717,144

[22] Filed: Aug. 24, 1976

[51] Int. Cl.[2] ..... E06C 1/18; E06C 1/24

[52] U.S. Cl. ..... 182/22; 182/119

[58] Field of Search ..... 182/118, 119, 22, 27, 182/104, 185, 20

[56] References Cited

U.S. PATENT DOCUMENTS

| | | | |
|---|---|---|---|
| 3,012,627 | 12/1961 | Mitchell | 182/104 |
| 3,782,498 | 1/1974 | Gleisen | 182/119 |

*Primary Examiner*—Reinaldo P. Machado
*Attorney, Agent, or Firm*—Jacob L. Kollin

[57] ABSTRACT

A brace for converting an extension ladder into a stepladder. The brace comprises a pair of spaced clamping members for securing two diverging extension ladder sections. The clamping members comprise a pair of rods having U-shaped clamps at each of their ends. The pairs of rods are secured by channel sections. An adjustable device for rigid bracing of the ladder sections is provided.

3 Claims, 4 Drawing Figures

FIG. 1
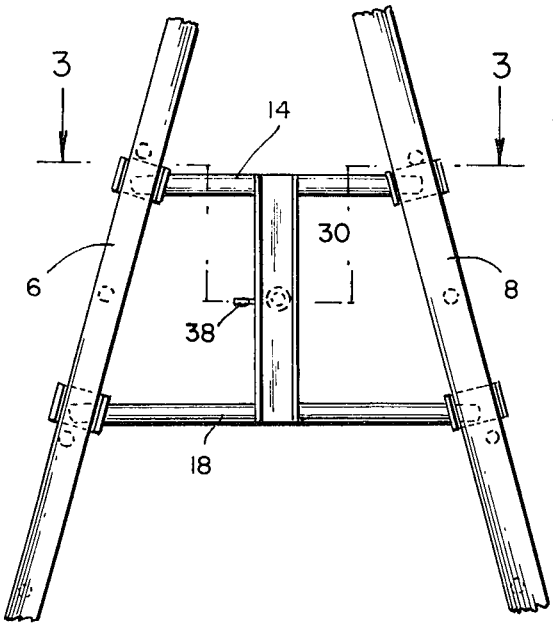
FIG. 2
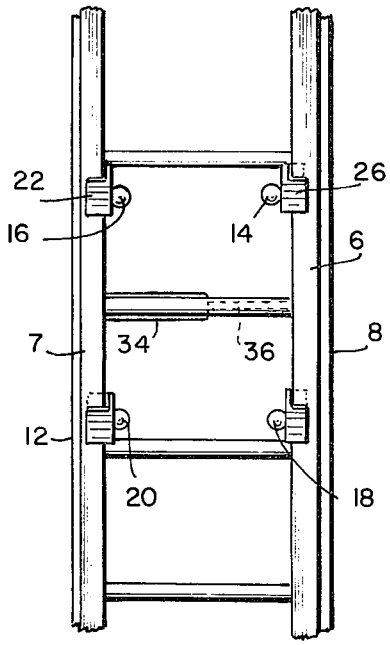
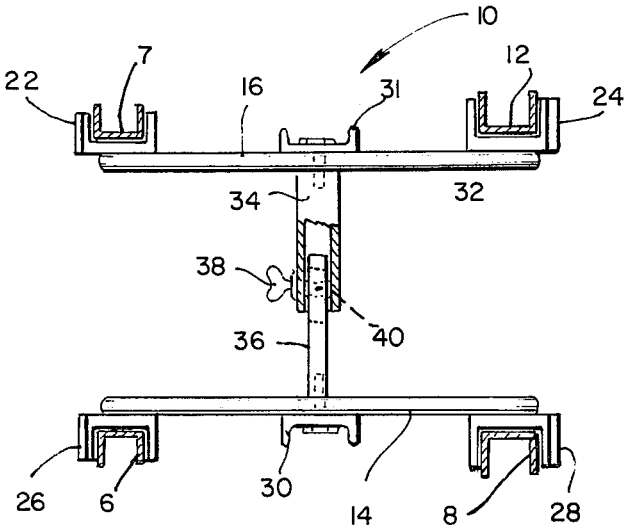
FIG. 3
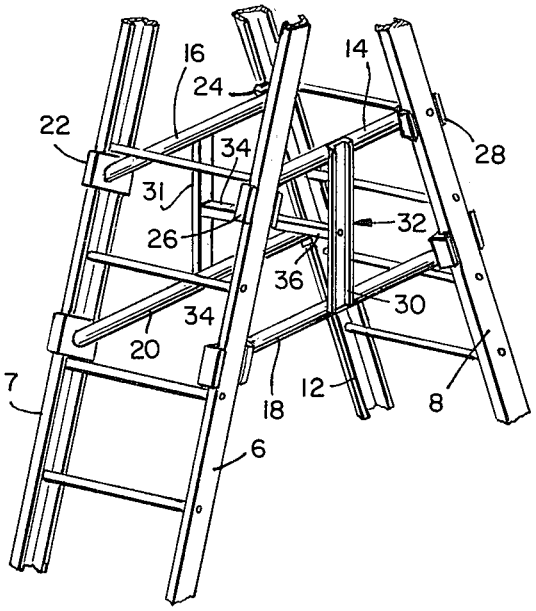
FIG. 4

DEVICE FOR CONVERTING AN EXTENSION LADDER INTO A STEPLADDER

BACKGROUND OF THE DISCLOSURE

The invention relates to ladders and more particularly to a bracing device for converting sections of an extension ladder into a stepladder.

One object of the invention is to provide a device of the above character which will function as a brace, rigidly securing together a pair of diverging ladder sections to form a step-ladder.

Another object of the invention is to provide adjustable means for imparting rigidity to a stepladder assembled with the use of said device.

A further object is to provide a device which will assure safety to persons using it.

Yet another object is to provide such a device, which is simple in construction, inexpensive to manufacture and manipulate, compact, efficient and durable.

These and other objects of the invention will become apparent from the following description in connection with the appended drawing illustrating a preferred embodiment of the invention. It is to be understood, however, that these are given by way of illustration and not of limitation and that changes may be made in the detail, construction, form and size of the parts, without affecting the scope of the invention sought to be protected. In the drawing:

FIG. 1 shows one end of the device as employed in conversion of the extension ladder into a stepladder, in side elevation;

FIG. 2 is an elevational view of a part of an extension ladder section, showing the manner of attachment of the device;

FIG. 3 is a section taken on line 3—3 of FIG. 1 and

FIG. 4 is a perspective view of the top portions of an extension ladder, formed into a stepladder.

Referring now to the Figures in detail, the top portions 6, 8 of an extension ladder after having been inclined at an angle of 28° opposite one another are rigidly secured together by sliding the brace 10 into engagement with their opposite ladder runners 6,7,8,12, while spreading the brace members, such as 14,16 and 18,20, shown in perspective in FIG. 4. These members are formed by securing U-channels, such as 22,24,26,28 to bars 14 and 16, respectively. The U-channels are welded angularly to the ends of the bars, so that they may intimately engage the ladder runners, securing these rigidly and thereby providing complete safety for those using the device.

In order to assure rigid engagement of the channels, such as 22,24,26 and 28, with the ladder runners, both the top pairs of upper and lower bars, as 14,16 and 18,20, are connected by means of vertical U-channels 30,31.

After the extension ladder sections have been set up angularly opposite one another, and the device thereon, tightening of the device for rigidity is obtained by adjusting spreader member 32. The spreader member is formed of a horizontal U-channel section 34, secured to channel member 31. A horizontal rod 36 is secured to vertical U-channel 30. The rod is slidable in channel section 34 and is provided with an adjusting thumb screw 38 slidable in slot 40 of channel section 34.

While the inventive device has been described by way of example as one which is adapted to brace extension ladder sections inclined at an angle of 28°, it is not limited to such an angle. It may be constructed to brace ladder sections inclined at other angles, to form a stepladder.

We claim:

1. A device for converting an extension ladder into a stepladder, comprising means for bracing a pair of spaced diverging top portions of a pair of extension ladder sections, said means comprising a pair of spaced clamping members having means for spacedly engaging opposite top portions of the extension ladder sections and adjustable means for securing said bracing means in rigid engagement with the opposite top portions of the extension ladder sections, wherein each of said pair of clamping members comprises a pair of spaced upper and lower bars, a channel securing each said pair of bars to one another midway of said bars and U-shaped clamp elements secured to each of the ends of said bars.

2. The device, as claimed in claim 1, wherein said U-shaped clamp elements are secured angularly of the ends of said bars.

3. The device as claimed in claim 2, wherein said adjustable means for securing said bracing means in rigid engagement with the ladder sections comprises a rod secured perpendicularly to one of said channels, a track secured to the other of said channels and provided with a longitudinal slot, said rod being slidable in said track, and a thumb screw on said rod extending through said slot for securing said rod in a predetermined position in said track.

* * * * *